US011827320B2

(12) United States Patent
Davies

(10) Patent No.: US 11,827,320 B2
(45) Date of Patent: Nov. 28, 2023

(54) FLOTATION VEST WITH REPOSITIONABLE COLLAR MEMBER

(71) Applicant: Aqua-Leisure Recreation, LLC, Avon, MA (US)

(72) Inventor: Conor Newton Davies, Boston, MA (US)

(73) Assignee: Aqua-Leisure Recreation, LLC, Stoughton, MA (US)

( * ) Notice: Subject to any disclaimer, the term of this patent is extended or adjusted under 35 U.S.C. 154(b) by 0 days.

(21) Appl. No.: 17/733,020

(22) Filed: Apr. 29, 2022

(65) Prior Publication Data

US 2022/0348299 A1 Nov. 3, 2022

Related U.S. Application Data

(60) Provisional application No. 63/181,659, filed on Apr. 29, 2021.

(51) Int. Cl.
*B63C 9/135* (2006.01)

(52) U.S. Cl.
CPC ..... *B63C 9/135* (2013.01)

(58) Field of Classification Search
CPC .... B63C 9/135; B63C 9/115; B63C 2009/133
See application file for complete search history.

(56) References Cited

U.S. PATENT DOCUMENTS 5,152,706 A * 10/1992 Fister ..... B63C 9/115 441/106
6,551,161 B2 4/2003 Chern et al.
6,659,689 B1 12/2003 Courtney et al.
2002/0072287 A1* 6/2002 Courtney ..... B63C 9/115 441/123
2014/0216240 A1* 8/2014 Hellweg ..... B63C 9/1255 441/90

OTHER PUBLICATIONS

U.S. Appl. No. 29/833,431, filed Apr. 4, 2022, Davies.

* cited by examiner

*Primary Examiner* — Andrew Polay
(74) *Attorney, Agent, or Firm* — Wolf, Greenfield & Sacks, P.C.

(57) ABSTRACT

A buoyant vest having a body portion that is securable around the upper torso of the wearer. The body member has a front portion and a back portion affixed together to form a neck opening and a shoulder portion one each side of the neck opening A buoyant collar member may be removably attached to the shoulder portions and may be selectively positioned at the front portion of the vest to support the wearer's chin, or at the back portion of the vest to provide support to the user's neck, when the user is in water.

2 Claims, 6 Drawing Sheets

FLOTATION VEST WITH REPOSITIONABLE COLLAR MEMBER

RELATED APPLICATION

This application claims priority under 35 U.S.C. Section 119(e) to U.S. Provisional Application Ser. No. 63/181,659, entitled "VEST WITH REPOSITIONABLE COLLAR MEMBER," filed on Apr. 29, 2021, which application is hereby incorporated by reference in its entirety for all purposes.

SUMMARY OF THE INVENTION

This invention relates to a swimming aid in the form of a buoyant vest, and particularly to a swimming aid for children. The vest includes a collar member that may be positioned either at the upper front edge of the vest to provide support for the user's chin, or at the upper back edge of the vest to support the neck of the user, or may be removed from the vest entirely.

BACKGROUND OF THE INVENTION

Buoyant vests are popular aids used in familiarizing children with water and helping them learn to swim. The vests often include a back portion and two front portions that wrap around the upper torso of the child, the two front portions being fastenable together to fit the vest to the child. A child wearing such a vest benefits from the additional buoyant support for his or her neck or chin, depending on the position of the child in the water.

One aspect of the vest of the instant invention comprises a buoyant vest of known configuration, having a body portion that is securable around the upper torso of the wearer and having a neck opening. A buoyant collar member attached to the vest may be selectively positioned either at the front of the vest to provide support for the wearer's chin, or at the back of the vest to support the user's neck. Or the collar member may be removed from the vest altogether, if so desired.

DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION OF THE INVENTION

Figure 1:
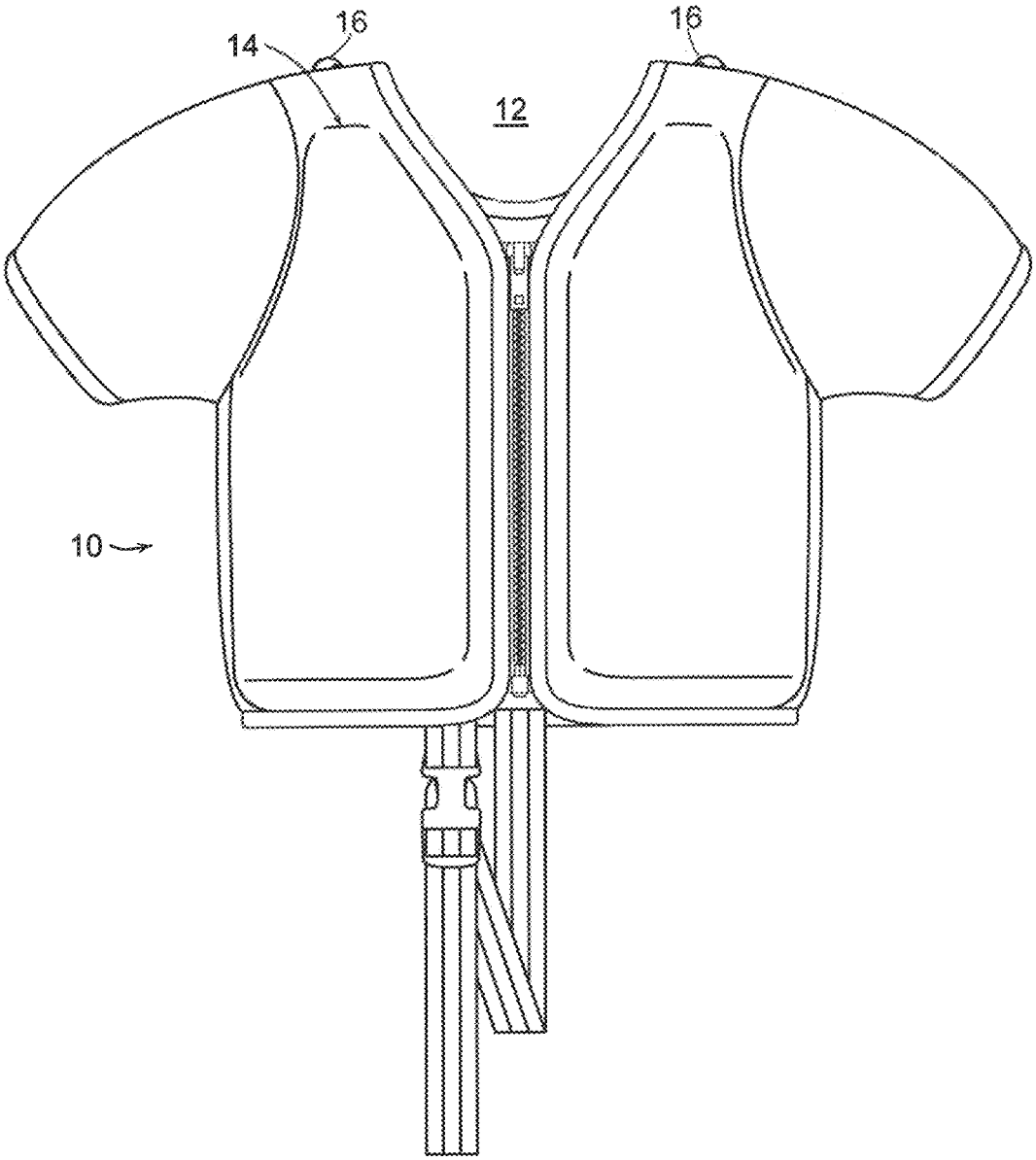
FIG. 1 is a depiction of the front side of a flotation vest, the vest having a loop located on each shoulder of the vest.
Figure 2:
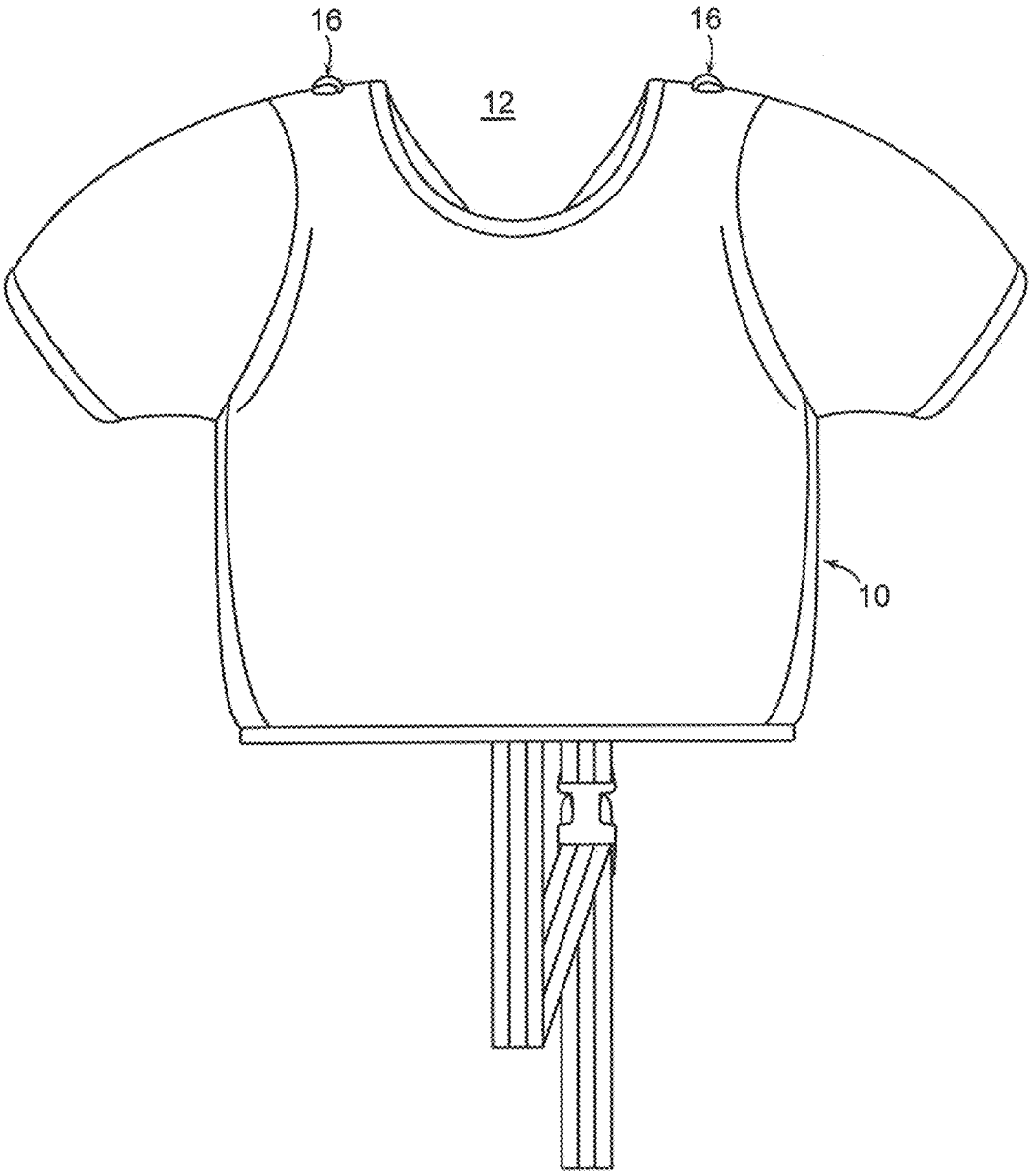
FIG. 2 depicts the back side of the vest of FIG. 1.

As seen in FIGS. 1 and 2, vest 10 is of known construction, having a body member with a back portion and two front portions attached to the back portion. The two front portions may be fastened together to fit the vest to the child, here by a zipper connecting the two front portions. The back and front portions are affixed to each other to form two shoulder portions and a neck opening 12. Buoyant pads 14 may be incorporated within the front portions of the vest as shown, as known by those skilled in the field.

Figure 3:
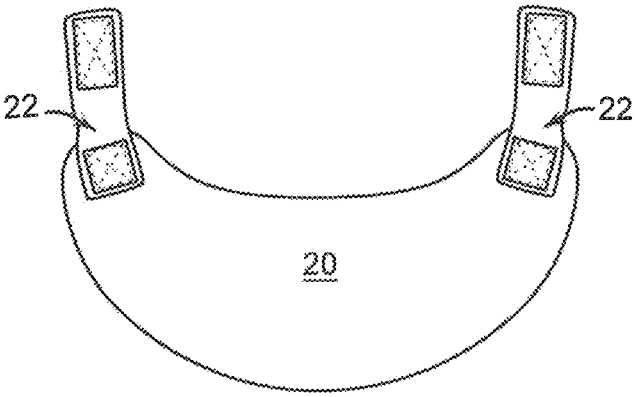
FIG. 3 depicts a collar member adapted for removable attachment to the flotation vest.

Loops 16 are located on the shoulder portions of the vest, one on each side of the neck opening 12, and are adapted for connection with a collar member 20 depicted in FIG. 3. Attached to collar member 20 are two closure members 22 that allow collar member 20 to be removably attached to vest 10, and, when attached, to be selectively moved from a position at the front of the vest to a position at the back of the vest, as described below. Collar member 20 comprises material of sufficient buoyancy to support the head of the user on water, as discussed below.

Figure 4:
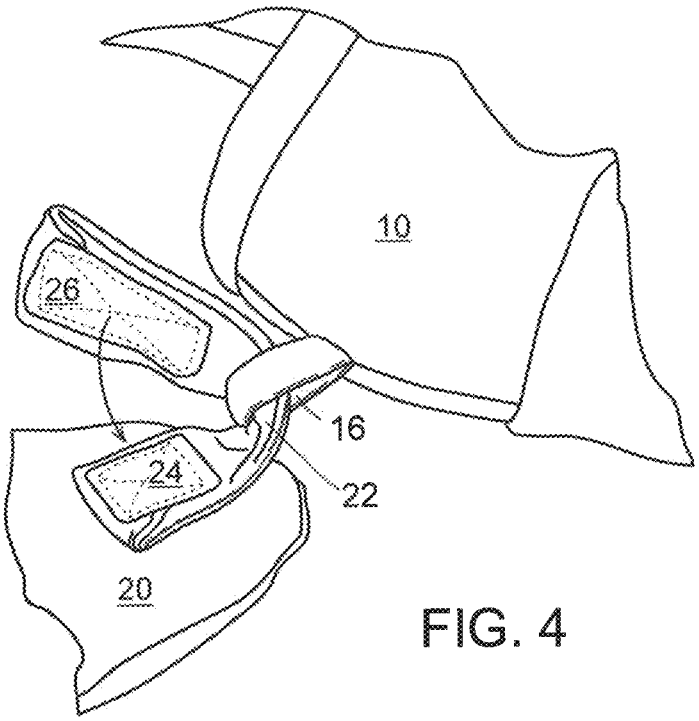
FIG. 4 depicts a way in which the collar member may be removably attached to the vest.
Figure 5:
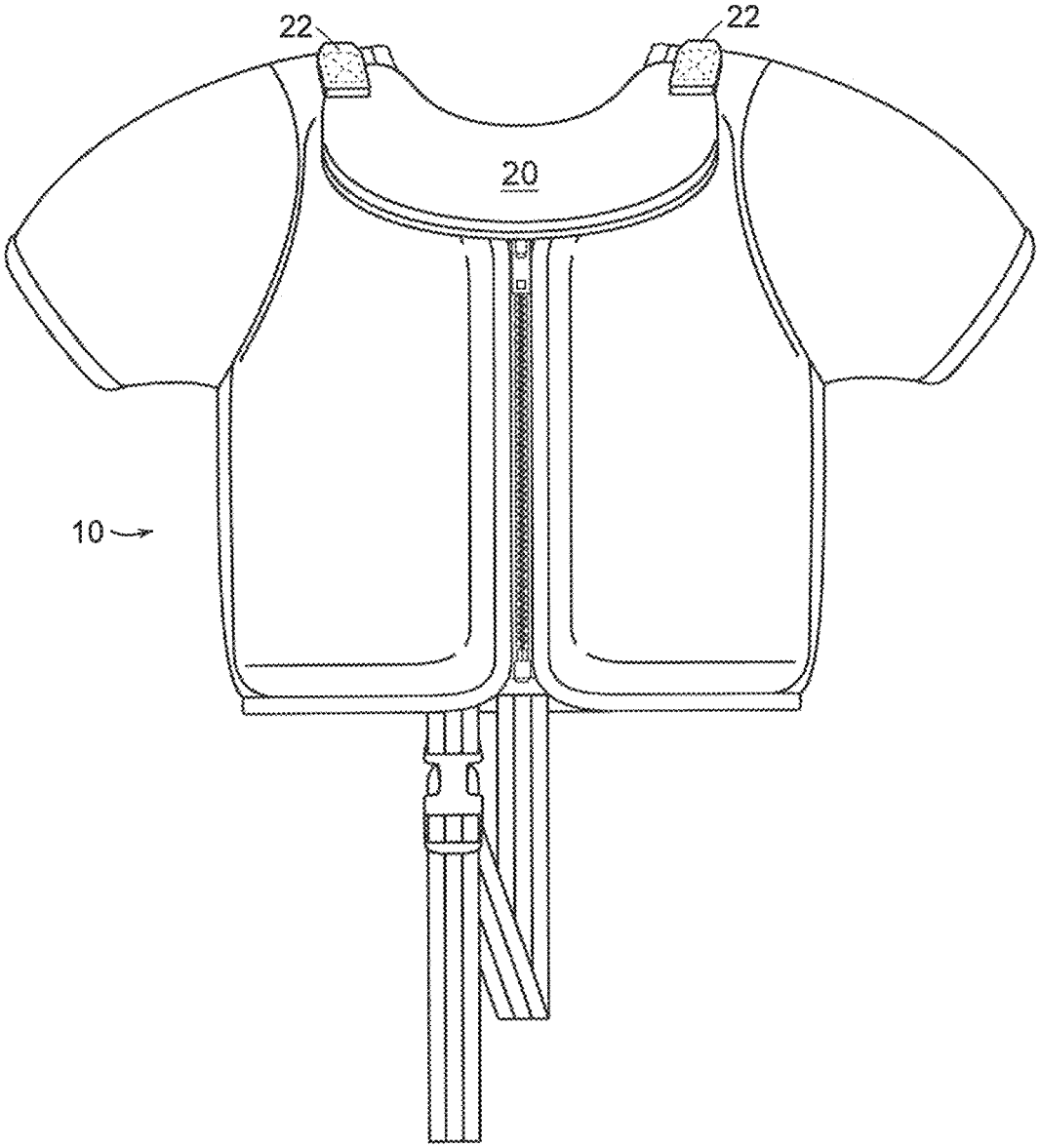
FIG. 5 shows the collar member attached to the vest and positioned at the front of the vest.
Figure 6:
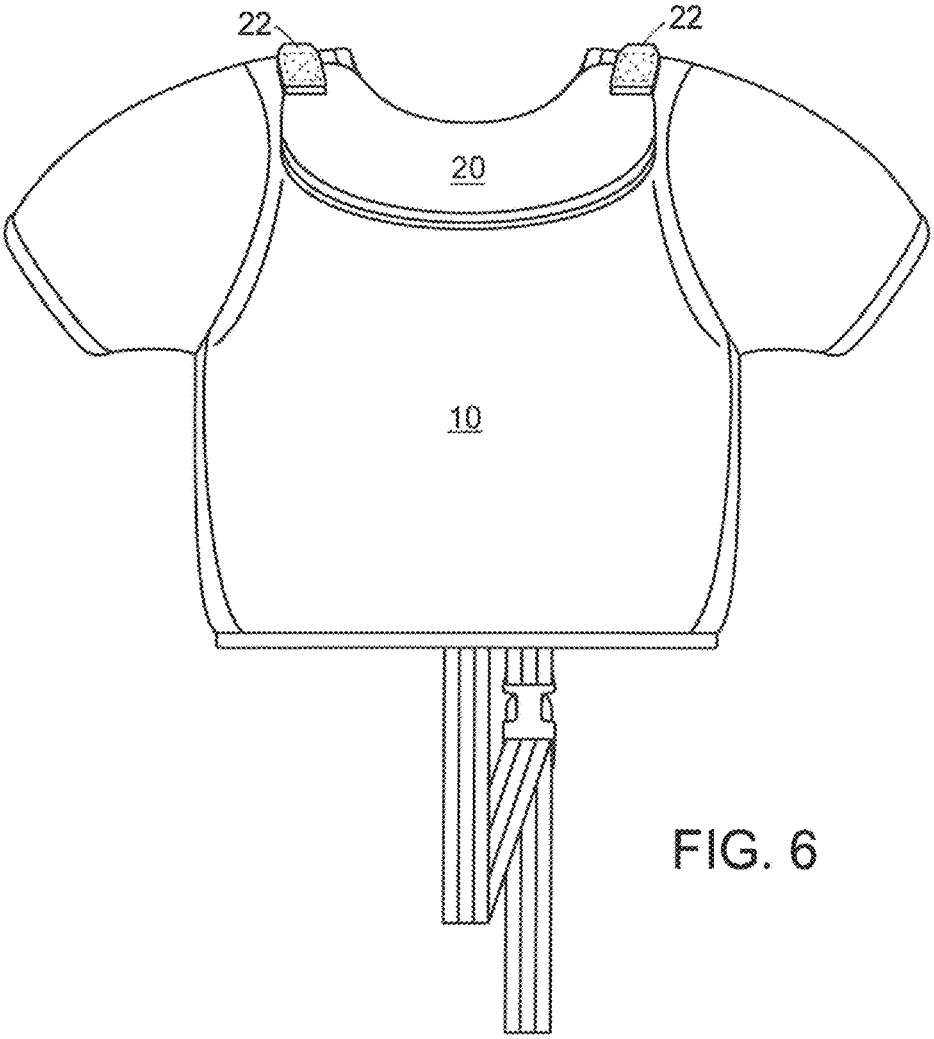
FIG. 6 depicts the collar member attached to the vest and positioned at the back of the vest.

FIG. 4 depicts vest 10, collar member 20, and one of the two closure members 22. The closure member 22 comprises an elongated strip of material having a fastening device affixed thereto. In this case, the fastening device is a hook-and-loop fastener comprising elements 24 and 26. One end of closure member 22 is fixed to collar member 20, while the other end may be threaded through loop 16 so that hook-and-loop elements 24 and 26 may be mated to each other to removably secure the collar member to the vest. By this construction, closure members 22 are free to move about loops 16 so that the collar member may be positioned either at the front of the vest, as in FIG. 5, or at the back of the vest, as in FIG. 6.

Figure 7:
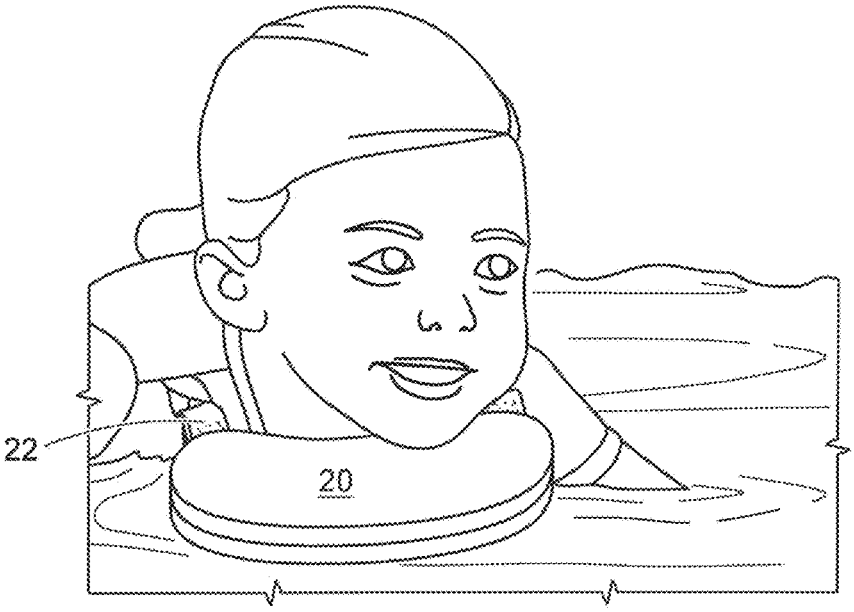
FIG. 7 is an illustration of a child wearing the flotation vest, with his or her chin resting on a buoyant collar member attached to the vest.
Figure 8:
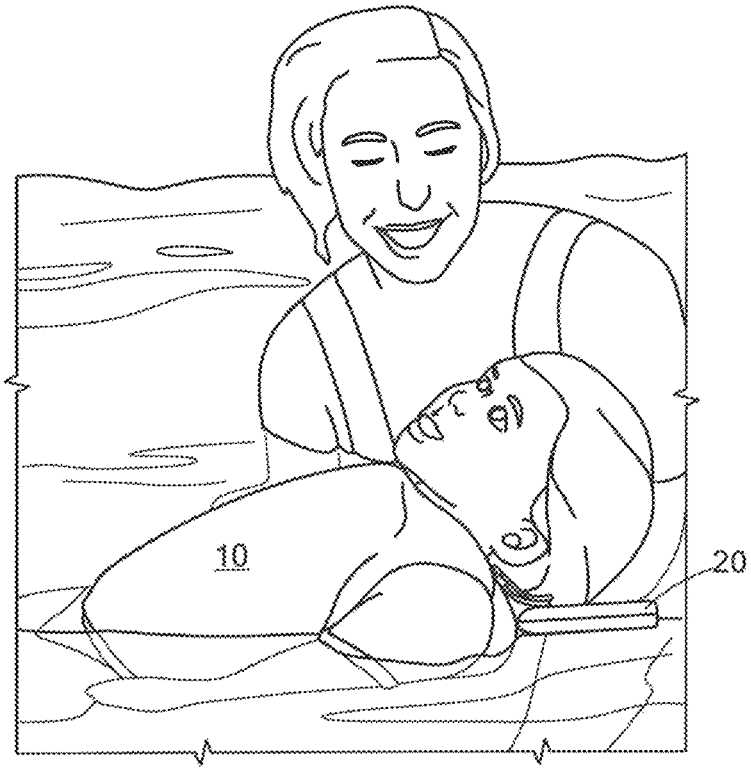
FIG. 8 is an illustration of a child wearing the flotation vest, with the back of his or her head resting on a buoyant collar member attached to the vest.
Figure 9:
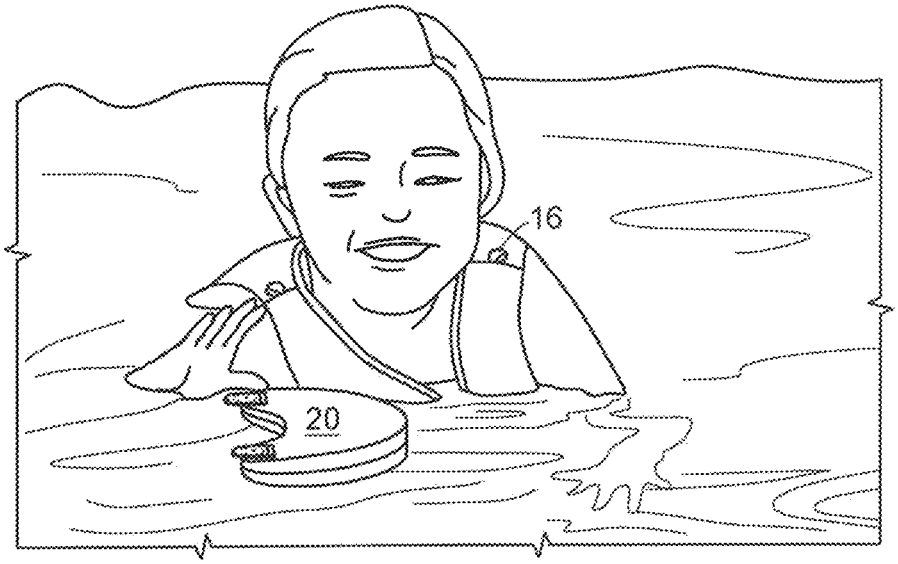
FIG. 9 is an illustration of a child wearing the flotation vest, but with the collar member detached from the vest.

A child wearing vest 10 with collar member 20 attached thereto is depicted in FIG. 7, the collar member being positioned at the front of the vest and providing buoyant support for the child's chin and head. FIG. 8 illustrates a child wearing vest 10 with collar member 20 positioned at the back of the vest and providing buoyant support for the child's neck and head. FIG. 9 depicts a child wearing vest 10 but with collar member 20 detached from the vest.

The fasteners on closure member 22 may comprise hook-and-loop fasteners, as depicted, or button and snap connectors, or other suitable fastening devices known to those of ordinary skill in the art.

From the description of at least one embodiment of the present disclosure, various alternations, modifications, and improvements will readily occur to those skilled in the art. Such alterations, modifications, and improvements are intended to be within the scope and spirit of the disclosure. Accordingly, the foregoing description is by way of example only and is not intended to be limiting.

What is claimed is:

1. A buoyant vest comprising:

a body member having a front portion and a back portion, said front portions being affixed to said back portion to form a neck opening and two shoulder portions, one on each side of said neck opening;

at least one loop of material affixed to each of the shoulder portions;

a buoyant collar member comprising attachment means for removably attaching said collar member to said vest in cooperation with said loops of material, whereby said collar member may be selectively positioned at the front portion or at the back portion of the vest, near the neck opening, wherein the attachment means comprises a closure member comprising an elongated strip of material having a first end and a second end, the first end being affixed to said collar member and the second end being removably attachable to the first end after said second end is passed through one of said loops.

2. The buoyant vest of claim 1, wherein the first end of the closure member comprises one element of a hook-and-loop fastener, and the second end of the closure member comprises a second element of the hook-and-loop fastener.

* * * * *